United States Patent [19]

Migita et al.

[11] Patent Number: 4,910,552

[45] Date of Patent: Mar. 20, 1990

[54] AUTOMATIC DOCUMENT FEEDER FOR ELECTROPHOTOGRAPHIC COPYING MACHINE WITH A DRUM FOR SUPPORTING A DOCUMENT

[75] Inventors: Haruyoshi Migita, Nara; Hirokazu Matsuura; Syogo Iwai, both of Yamatokoriyama, all of Japan

[73] Assignee: Sharp Kabushiki Kaisha, Osaka, Japan

[21] Appl. No.: 300,253

[22] Filed: Jan. 19, 1989

Related U.S. Application Data

[63] Continuation of Ser. No. 201,312, May 26, 1988, abandoned, which is a continuation of Ser. No. 73,337, Jul. 13, 1987, abandoned, which is a continuation of Ser. No. 849,155, Apr. 7, 1986, abandoned.

[30] Foreign Application Priority Data

| | | | |
|---|---|---|---|
| Apr. 15, 1985 | [JP] | Japan | 60-80658 |
| Apr. 15, 1985 | [JP] | Japan | 60-80659 |
| Apr. 15, 1985 | [JP] | Japan | 60-80660 |

[51] Int. Cl.[4] ..... G03G 21/00

[52] U.S. Cl. ..... 355/203; 355/207; 355/308; 271/275

[58] Field of Search ..... 271/256, 258, 259, 275; 355/3 SH, 14 SH, 14 E, 14 R, 203, 207, 204, 208, 230, 308, 313

[56] References Cited

U.S. PATENT DOCUMENTS

| | | | |
|---|---|---|---|
| 3,936,180 | 2/1976 | Willard et al. | 355/14 R |
| 3,972,522 | 8/1976 | Wallace | 271/258 X |
| 4,281,919 | 8/1981 | Nomura et al. | 355/3 SH |
| 4,448,515 | 5/1984 | Ishikawa | 355/14 R |
| 4,620,782 | 11/1986 | Kurando et al. | 271/275 X |
| 4,634,113 | 1/1987 | Matsuda et al. | 271/259 |
| 4,657,375 | 4/1987 | Watanabe et al. | 355/14 R |
| 4,803,519 | 2/1989 | Asada et al. | 355/3 SH X |

*Primary Examiner*—A. T. Grimley
*Assistant Examiner*—Ed Pipala
*Attorney, Agent, or Firm*—Flehr, Hohbach, Test, Albritton & Herbert

[57] ABSTRACT

An electrophotographic copying machine of a type having a drum for supporting a document to be copied therearound and being provided with an automatic document feeder adapted to carry out a preliminary copying operation for testing includes a timer for counting up a predetermined period of time after the completion of preliminary copying, or is alternatively so programmed that a choice can be made after a preliminary copying operation whether a document remaining in the copying position should be ejected. Jamming of documents and injury to the copying machine can be avoided effectively thereby.

6 Claims, 3 Drawing Sheets

Figure 1:
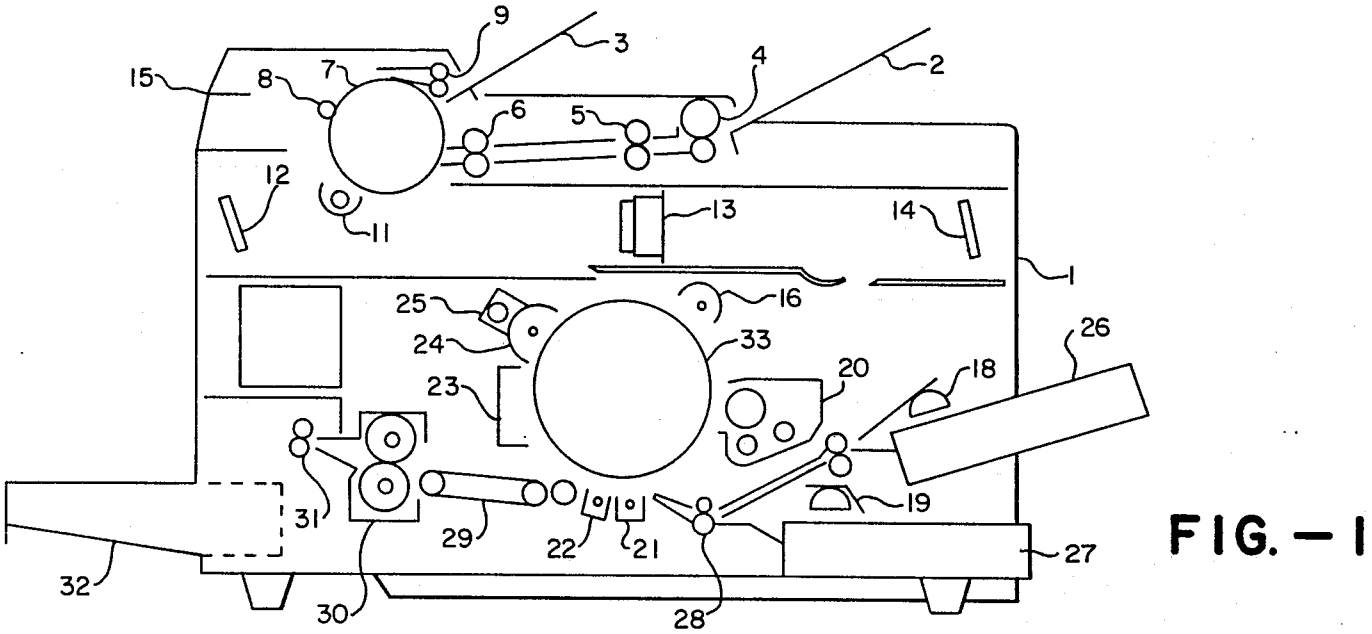

AUTOMATIC DOCUMENT FEEDER FOR ELECTROPHOTOGRAPHIC COPYING MACHINE WITH A DRUM FOR SUPPORTING A DOCUMENT

This is a continuation of Ser. No. 201,312, filed 5/26/88, which is a continuation of Ser. No. 073,337, filed 7/13/87, which is a continuation of Ser. No. 849,155, filed 4/7/86, all now abandoned.

This invention relates to an electrophotographic copying machine of a type having a drum for supporting a document to be copied therearound and being provided with an automatic document feeder such that preliminary copying can be effected for testing prior to the actual copying operation.

When an electrophotographic copying machine is used for a copying operation but the sizes of the documents to be copied (originals) are irregular or the image darkness is not uniform, it is necessary to ascertain whether magnification and exposure have been appropriately set. On the other hand, the purpose of an automatic document feeder is to transport the original documents in a document tray to a copying position and to eject them into an ejection tray after the copying is finished. Since each document must be transported to the copying position prior to the scanning by an optical system, the document which comes after the one being copied now is already engaged with the document-transporting means if there are more than one document set in the document tray. Thus, if a single cycle of copying operation is effected for testing with a plurality of documents placed in the document tray, the first document will be ejected into the ejection tray after its copying is completed while the second document will be found already engaged with the document-transporting means. In order to carry out the actual copying, therefore, it is necessary to return the first and second documents back into the document tray. When a plurality of documents which are paginated sequentially are to be copied, therefore, the operation becomes quite cumbersome.

In view of the difficulty described above, a copying machine with test printing capability has been disclosed in Japanese Utility Publication (Kokai) 53-102633. This publication relates, however, merely to an apparatus with which only a single document is preliminarily run for testing, independently of the total number of documents to be copied. The method of handling documents after this preliminary testing operation was not considered at all. Thus, if a document is left at the copying position at the end of the preliminary testing, it will adversely affect the subsequent copying operations. In the case of an automatic document feeder making use of a drum, in particular, the document will curl up after remaining wrapped around it for an extended period of time. This may cause documents to get stuck when they should be ejected. Documents may thereby become lost and cause the machine to malfunction. In short, work efficiency of the machine is likely to be severely affected.

It is therefore an object of the present invention in view of the above to provide an electrophotographic copying machine of a type having a drum for supporting a document to be copied therearound and being provided with an automatic document feeder which can prevent a document from remaining in the copying position for a long time after the completion of preliminary copying so that malfunctioning can be prevented in the subsequent operations and, when a drum is involved, that the documents will not curl up or become lost and the machine will not be damaged by the jamming when documents are ejected.

It is another object of the present invention to provide such an electrophotographic copying machine with an automatic document feeder which will not cause documents to jam up when the power is shut off while a document is in the copying position and the copying operation is subsequently resumed but is capable of reliably setting a document at the copying position for the next copying operation.

The above and other objects of the present invention are achieved by an electrophotographic copying machine of the present invention. According to one embodiment of the present invention, an electrophotographic copying machine with an automatic document feeder comprises a document ejecting means for ejecting out a document remaining at the copying position and a selecting means for deciding whether the operation of this document ejecting means should be effected or not when the preliminary copying for testing has been completed. The feeder, for example, may include a timer which starts up after the preliminary copying operation is completed and is reset when the next operation is selected, and a validating means for making the operation of the aforementioned document ejecting means effective after the timer has measured a predetermined length of time. With a structure as described above, the document remaining at the copying position can be ejected by the document ejecting means either when this ejecting means is activated by the selecting means after the preliminary copying is completed or when a predetermined length of time has elapsed so that documents are prevented from remaining for a long time at the copying position.

According to another embodiment, a detecting means may be provided such that the aforementioned document ejecting means is activated if the presence of a document at the copying position is detected by this detecting means when the power source is in the ON condition. Thus, even if the power is switched off when a document is still at the copying position, it will be ejected out when the next user switches the power on for the next copying operation. This will make it easier to set the next document correctly at the copying position and jamming of documents inside the copying machine as well as a loss of documents and damage to the machine can be prevented.

Figure 2:
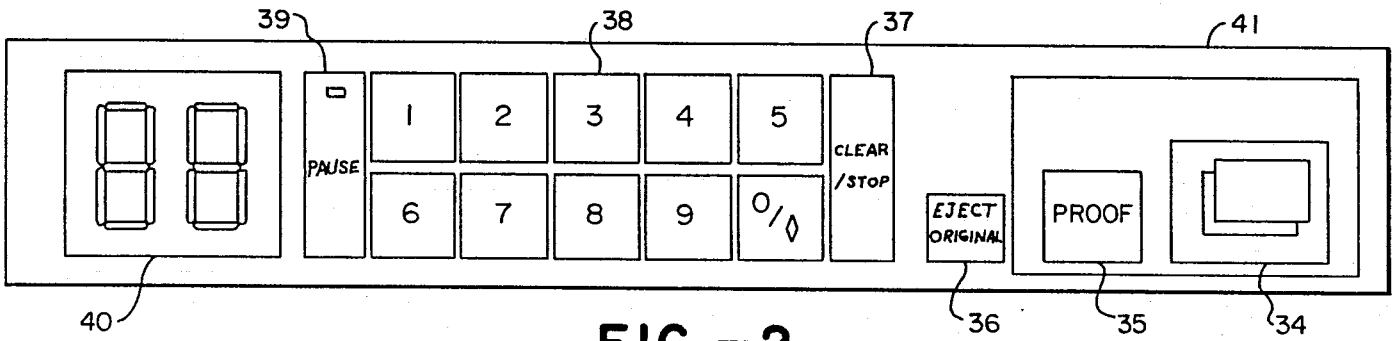
Figure 3A:
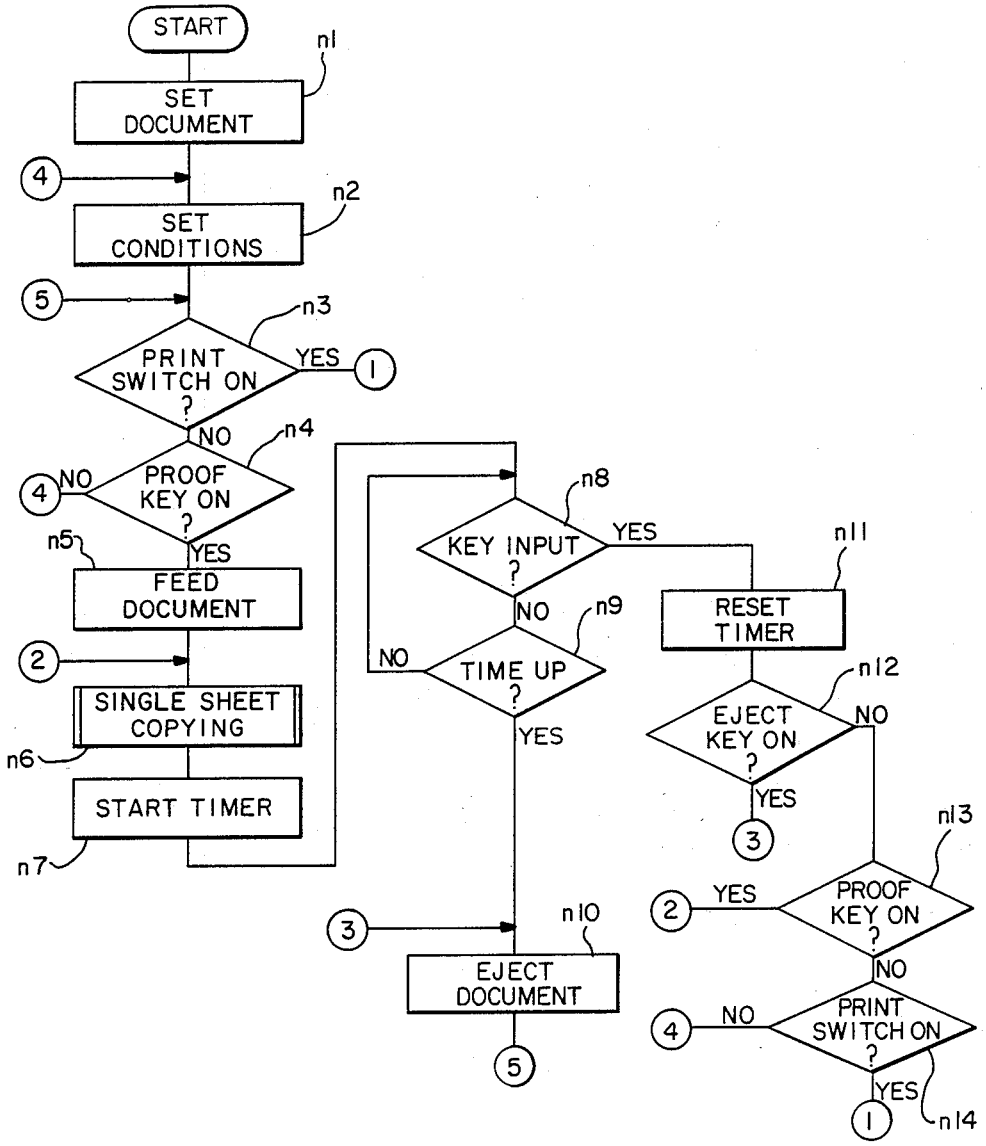
Figure 3B:
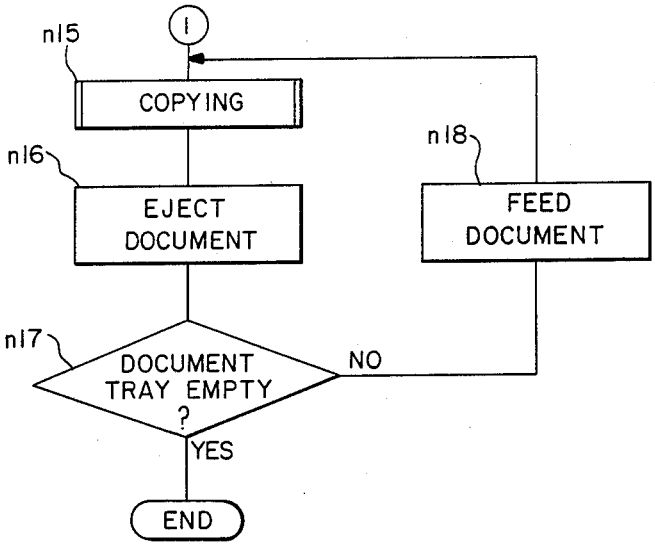
Figure 3C:
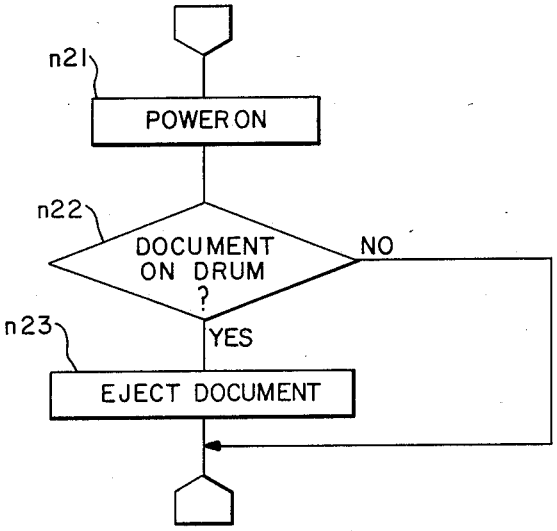

The accompanying drawings, which are incorporated in and form a part of the specification, illustrate an embodiment of the present invention and, together with the description, serve to explain the principles of the invention. In the drawings:

FIG. 1 is a sectional view for schematically showing the structure of an electrophotographic copying machine with an automatic document feeder embodying the present invention, FIG. 2 is a plan view of an operating panel for the electrophotographic copying machine of FIG. 1, and FIG. 3 is a flow chart of the operation of the electrophotographic copying machine of FIG. 1.

Reference being made to FIG. 1 which schematically shows the structure of an electrophotographic copying machine according to an embodiment of the present invention, an automatic document feeder 15 with a document tray 2 and an ejection tray 3 is at the upper portion of a housing 1. The automatic document feeder 15 contains a document drum 7, and there are document supplying rollers 4, document feeding rollers 5 and document timing rollers 6 disposed between the document drum 7 and the document tray 2. On the outer periphery of the document drum 7 are document ejection rollers 8 and 9 disposed rotatably. A lamp 11 is mounted below the document drum 7, and forms an optical system together with reflective plates 12 and 14 and a lens 13 disposed in the lower section of the automatic document feeder 15.

Inside the housing 1 near the center below the aforementioned optical system, there is a photosensitive drum 33 with a static charger 16, a developing station 20, a transfer charger 21, a separation charger 22, a cleaner 22, a neutralizing charger 24 and a neutralizing lamp 25 disposed near its outer periphery to form a processing section. On the right-hand side (with reference to FIG. 1) inside the housing 1, there are not only paper cassettes 26 and 27 but also paper supplying rollers 18 and 19 and they together form a paper supplying section. On the left-hand side inside the hosing 1, there are a paper ejection tray 32 and paper ejection rollers 31, and they together form a paper ejecting section. There are synchronization rollers 28 between the aforementioned paper supplying section and the transfer position in the processing section which is between the photosensitive drum 33 and the transfer charger 21. A conveyor belt 29 and a fixing station 30 are disposed between the transfer position and the paper ejecting section. A paper route is thus formed with the structure described above from the paper supplying section to the paper ejecting section through the transfer position in the processing section.

Reference being made next to FIG. 2, numeral 41 generally indicates an operating panel for the electrophotographic copying machine described above. There is provided a print switch 34 at its right-hand corner, and a proof key 35 is disposed adjacent to it. A set of number keys 38 is provided near the center of the panel 41 and the number of copies inputted by these keys is displayed on a display means 40. If the aforementioned print switch 34 is operated with a number displayed on this display means 40, copying operation is repeated the same number of times as that inputted by the number keys 34 and displayed on the display means 40. If the proof key 35 is operated, on the other hand, the copying operation is effected only once, independently of the number inputted by the number keys 38 and displayed on the display means 40. This represents what was called the preliminary copying before and the document in this case remains in the copying position, wrapped around the document drum 7. Numeral 36 indicates an eject key which is a means for electing to eject the document wrapped around the document drum 7 into the document ejection tray 3. Numeral 37 indicates a clear/stop key for either stopping the copying operation or cancelling the number inputted by the number keys 38. Numeral 39 indicates a pause key for temporarily interrupting the copying operation.

The operation of the electrophotographic copying machine with an automatic document feeder described above will be explained next by way of the flow chart shown i FIG. 3. A document is initially set on the document tray 2 of the automatic document feeder 15 (n1) and conditions such as magnification, exposure, number of copies, etc. are subsequently inputted by the number keys 38 on the panel 41 (n2). Next, it is checked whether the print switch 34 has been operated (n3), and the program proceeds to Step n4 if the print switch 34 has not been operated. Then, it is checked whether the proof key 35 has been switched on (n4). The program proceeds to Step n5 if the proof key 35 was found in ON position in Step n4 and the document is transported from the document tray 2 to the document drum 7 by the rotations of the document supplying rollers 4, the document feeding rollers 5 and the document timing rollers 6. The motion of the document itself is started initially by the rotations of the document supplying rollers 4 and its orientation becomes corrected when the document hits the document feeding rollers 5 which are then not rotating. Next, the document feeding rollers 5 cause the document to move forward and to hit the document timing rollers 6 which are then not rotating. The document timing rollers 6 begin to rotate in synchronism with the rotation of the document drum 7 and the front edge of the document is engaged to a groove (not shown) formed on the external surface of the document drum 7. A claw-like member (not shown) on the document drum 7 is employed to hold the document and to wrap it around its surface. Thereafter, the program proceeds to Step n6 and effects a single copying operation.

During the aforementioned copying operation, the document drum 7 rotates in synchronism with the rotation of the photosensitive drum 33 and the reflected beam of the lamp 11 from the document is made incident on the surface of the photosensitive drum 33 by the reflective plates 12 and 14 and the lens 13. The surface of the photosensitive drum 33 is charged by the static charger 16 prior to the incidence of the aforementioned beam. Charges are removed from the areas which were exposed to the incident beam and a latent electrostatic image is formed where the beam was not made incident. A developing liquid is supplied from the developing station 20 and the latent image is converted into a visible image. Prior to the rotation of the photosensitive drum 33, a copying paper is brought to the position of the synchronization rollers 28 by the rotation of the paper supplying roller 18 or 19. The synchronization rollers 28 begin to rotate in synchronism with the rotation of the photosensitive drum 33 and the paper is delivered such that its front edge will touch an image edge line on the surface of the photosensitive drum 33 at the transfer position where the image formed on the surface of the photosensitive drum 33 is transferred to the surface of the copy paper by a discharge of the transfer charger 21. The paper, after undergoing the transfer process, is delivered to the fixing station by the motion of the conveyor belt 29. After the transferred image is fixed, the paper is ejected into the ejection tray 32 by means of the ejection rollers 31. The used toner remaining on the surface of the photosensitive drum 33 after the completion of the transfer process is collected by the cleaner 23 and is used again after it is electrically neutralized by the neutralizing charger 24 and the neutralizing lamp 25.

A timer T for measuring a predetermined fixed time interval is started (n7) when the aforementioned single copying operation, or the preliminary copying for testing, is completed. Next, it is checked whether there has been a key input by an operator (n8). The program proceeds to Step n9 if there has been no key input and checks whether the timer T has counted up the time. The program returns to Step n8 if the time is not up. If the time is up, the document drum 7 is rotated independently of the copying operation and the document wrapped around the document drum 7 is ejected into the document ejection tray 3 by the motions of the document ejection rollers 8 and 9 (n10). The Steps n7–n9 described above represent the operations of the timer means of the present invention and likewise Step n10 represents the operations of the means which activates the document ejecting means of the present invention.

If it is determined in Step n8 that there has been a key input, the timer T is reset (n11) and operations are effected according to the key input (n12–n14), that is, the program skips from Step n12 to Step n10 and the document wrapped around the document drum 7 is immediately ejected if the eject key 36 has been operated, the program skips from Step n13 to Step n6 and effects a preliminary copying operation if the proof key 35 has been operated, and the program advances from Step n14 to Step n15 if the print switch 34 has been operated. If it is found in Step n14 that the print switch 34 has not been operated, or if some other key operations were effected in Step n8 such as changes in copying conditions, the program skips to Step n2.

If it is found in Step n3 or Step n14 that the print switch 34 has been operated, the program advances to Step n15 where copying is effected as many times as the number inputted in Step n2. Next, the document is ejected into the document ejection tray 3 (n16) and it is examined whether there is another document on the document tray 2 (n17). If there is another document, the program advances to Step n18 and delivers this document to the document drum 7 as explained above to effect copying again (n 15). If no more document is found in Step n17, the operation is terminated. By repeating Steps n15–n18, a specified number of copies can be made continuously from all documents placed on the document tray 2.

A document will remain wrapped around the document drum 7 if power is switched off after the completion of a preliminary copying operation in Step n6 and before the timer T counts up the time or when the clear/stop key 37 was operated during a copying operation. When the power is switched on again (n21), however, the program checks whether there is a document on the document drum 7 (n22) and ejects it (n23) if it is determined that there is one. Step n22 above represents the operations of the aforementioned document detection means and Step n23 likewise represents the operations of the aforementioned means for activating the document ejecting means.

In summary, a timer is started according to the present invention in Steps n7–n10 after the completion of preliminary copying for testing and the document at the copying position is ejected after a predetermined length of time if there is no input for a next operation. The document can be ejected also by the eject key 36 if it becomes necessary to do so for stopping the copying after a preliminary copying operation or for correcting the order in which documents should be loaded. Moreover, jamming of paper can be avoided by Steps n21–n23 when power is switched off while a document is still at the copying position.

The foregoing description of a preferred embodiment of the invention has been presented for purposes of illustration and description. It is not intended to be exhaustive or to limit the invention to the precise form disclosed, and obviously many modifications and variations are possible in light of the above teaching. For example, the program of FIG. 3 may be modified so as to skip from Step n17 to Step n5 when a next document is present in the document tray 2, making it possible to elect execution of preliminary copying operations. The program may also be modified to skip from Step n21 to Step n23 directly after power is switched on and to carry out the document ejection operation independently of whether or not a document is remaining. Such modifications and variations which may be apparent to a person skilled in the art are intended to be included within the scope of the present invention.

What is claimed is:

1. An electrophotographic copying machine with an automatic document feeder comprising means for selectably entering a preliminary copying operation mode wherein a document is carried to a copying position for a single copying operation and kept at said copying position when said machine is set for single or multiple copying operation, ejecting means for ejecting a document remaining at said copying position, and selecting means for selectably determining whether to validate or to invalidate the operation of said ejecting means when a preliminary copying operation is completed in said preliminary copying operation mode.

2. The copying machine of claim 1 further comprising a document drum around which a document to be copied is rotated to reach and to be removed from said copying position.

3. An electrophotographic copying machine with an automatic document feeder comprising means for selectively entering a preliminary copying operation mode wherein a document is carried to a copying position for a single copying operation and kept at said copying position when said machine is set for single or multiple copying operation, ejecting means for ejecting a document remaining at said copying position, detecting means for detecting the presence of a document at said copying position, and validating means for validating the operation of said ejecting means if said detecting means detects a document at said copying position when power is switched on for said copying machine.

4. The copying machine of claim 3 further comprising a document drum around which a document to be copied is rotated to reach and to be removed from said copying position.

5. An electrophotographic copying machine with a rotatable drum and an automatic document feeder comprising means for selectively entering a preliminary copying operation mode wherein a document is transported on and around said drum to a copying position on said drum for a single copying operation and kept at said copying position when said machine is set for single or multiple copying operation, ejecting means for ejecting a document remaining at said copying position, a timer means adapted to start after the completion of said preliminary copying operation mode and to be reset when a subsequent operation is set and inputted, and validating means for validating the operation of said ejecting means when said timer means has counted a predetermined time period.

6. The copying machine of claim 5 further comprising a document drum around which a document to be copied is rotated to reach and to be removed from said copying position.

* * * * *